US010159858B2

(12) United States Patent
Lopez et al.

(10) Patent No.: US 10,159,858 B2
(45) Date of Patent: Dec. 25, 2018

(54) LEG STRAP ASSEMBLY AND SAFETY HARNESS INCLUDING THE SAME

(71) Applicant: WERNER CO., Greenville, PA (US)

(72) Inventors: Ivan D. Lopez, Hermitage, PA (US); Eric Miller, Carmel, IN (US)

(73) Assignee: WERNER CO., Greenville, PA (US)

( * ) Notice: Subject to any disclaimer, the term of this patent is extended or adjusted under 35 U.S.C. 154(b) by 113 days.

(21) Appl. No.: 15/343,326

(22) Filed: Nov. 4, 2016

(65) Prior Publication Data

US 2018/0126195 A1 May 10, 2018

(51) Int. Cl.
*A62B 35/00* (2006.01)

(52) U.S. Cl.
CPC ..... *A62B 35/0025* (2013.01); *A62B 35/0006* (2013.01); *A62B 35/0012* (2013.01); *A62B 35/0018* (2013.01); *A62B 35/0031* (2013.01)

(58) Field of Classification Search
CPC ..... A62B 35/0006; A62B 35/0012; A62B 35/0018; A62B 35/0025; A62B 35/0031
See application file for complete search history.

(56) References Cited

U.S. PATENT DOCUMENTS 1,775,736 A * 9/1930 Rose ..... A01G 3/08 182/6
3,757,893 A * 9/1973 Hobbs ..... A62B 35/0025 182/6
4,103,758 A * 8/1978 Himmelrich ..... A62B 35/0012 182/3
5,080,191 A 1/1992 Sanchez
5,220,976 A 6/1993 Gunter
5,615,750 A * 4/1997 Phillips ..... A62B 35/0031 182/6
6,290,111 B1 9/2001 Hedenberg et al.
6,378,465 B1 4/2002 Austin
6,942,630 B2 * 9/2005 Behan ..... A61F 5/0102 128/875
7,210,707 B2 5/2007 Schroth
7,490,610 B2 * 2/2009 Franklin ..... A62B 35/0025 128/869
7,979,919 B2 7/2011 Joran
8,061,479 B2 11/2011 Harris, Jr.
8,177,025 B2 5/2012 Lang et al.
(Continued)

FOREIGN PATENT DOCUMENTS

FR 2976495 A1 12/2012

OTHER PUBLICATIONS

European Patent Office, "Extended European Search Report from corresponding EP Regional application No. EP 17197127.8", dated Feb. 9, 2018, 5 pp.

*Primary Examiner* — Colleen M Chavchavadze
(74) *Attorney, Agent, or Firm* — Eckert Seamans Cherin & Mellott, LLC; Nathaniel C. Wilks

(57) ABSTRACT

A leg pad assembly for a safety harness, the leg pad assembly including a pair of leg pad portions structured to receive leg straps of the safety harness, a central pad portion connecting the pair of leg pad portions and structured to receive a seat strap of the safety harness, a pair of handles, wherein each handle is attached to one of the pair of leg pad portions, and elastic cording attached to each of the pair of handles and being structured to bias the pair of handles toward each other and against the pair of leg pad portions.

18 Claims, 7 Drawing Sheets

(56) References Cited

U.S. PATENT DOCUMENTS

| | | | | |
|---|---|---|---|---|
| 8,235,173 | B2 | 8/2012 | Kopp | |
| 8,292,028 | B2 | 10/2012 | Wise | |
| 8,321,972 | B1 | 12/2012 | Vetter | |
| 8,333,262 | B1 * | 12/2012 | Carpenter | A62B 35/0031 182/6 |
| 8,336,506 | B2 | 12/2012 | Zimmerman | |
| 8,443,937 | B2 | 5/2013 | Mordecai et al. | |
| 8,678,134 | B2 | 3/2014 | Wood | |
| 8,858,408 | B2 | 10/2014 | DeMeo | |
| 9,174,071 | B2 | 11/2015 | Seman et al. | |
| 9,457,208 | B2 * | 10/2016 | Seman | A62B 35/0025 |
| 9,649,515 | B2 * | 5/2017 | Theisen | A62B 35/0025 |
| D805,254 | S * | 12/2017 | Lopez | A62B 35/0012 D29/101.1 |
| 9,878,186 | B2 * | 1/2018 | Einhaus | A62B 35/0031 |
| 2005/0192159 | A1 | 9/2005 | Jackson et al. | |
| 2006/0102423 | A1 | 5/2006 | Lang et al. | |
| 2009/0159365 | A1 | 6/2009 | O'Brien | |
| 2009/0178194 | A1 | 7/2009 | Story | |
| 2010/0089694 | A1 | 4/2010 | Paul | |
| 2011/0174572 | A1 | 7/2011 | Myers | |
| 2011/0284321 | A1 * | 11/2011 | Hall | A62B 35/0025 182/3 |
| 2012/0048646 | A1 * | 3/2012 | Harris, Jr. | A62B 35/0093 182/6 |
| 2012/0217090 | A1 | 8/2012 | Green | |
| 2013/0048419 | A1 | 2/2013 | Nichols | |
| 2013/0205466 | A1 | 8/2013 | Arnold | |
| 2015/0060195 | A1 | 5/2015 | Sharp et al. | |
| 2015/0165247 | A1 | 6/2015 | Mursu et al. | |

* cited by examiner

LEG STRAP ASSEMBLY AND SAFETY HARNESS INCLUDING THE SAME

BACKGROUND

Field

The disclosed concept relates generally to fall protection systems, and in particular, to safety harnesses for use in fall protection systems.

Background Information

In fall protection systems, a worker typically wears a safety harness with an attached lifeline. The lifeline is then attached to an anchor, such as a roof anchor. If a worker begins to fall, the lifeline, harness, and anchor, working together, are operable to suspend the fall and bear the worker's weight. In some cases the worker may need to remain in the suspended position for an extended period of time. For example, a worker that falls from the roof of a building may be suspended on the side of the building until he is able to be retrieved.

Many type of safety harnesses are full body harnesses that include shoulder straps and leg straps. The shoulder straps and leg straps are typically formed from woven webbing material such as nylon or other similar materials. The lifeline is usually attached to the back of the harness around where the shoulder straps meet each other.

In the period immediately after a fall, the worker is generally suspended in a vertical orientation, similar to the position the worker would be when standing. When suspended in the vertical position, the force applied by the leg straps to support the worker's weight can be uncomfortable and unhealthy if maintained for an extended period of time. In the suspended position, it is difficult for the worker to reduce the force applied by the leg straps.

SUMMARY

These needs and others are met by embodiments of the disclosed concept in which a leg pad for a safety harness includes handles which allow a user to adjust a position of the safety harness and includes elastic cording that biases the handles against leg pad portions.

In accordance with one aspect of the disclosed concept, a leg pad assembly for a safety harness comprises: a pair of leg pad portions structured to receive leg straps of the safety harness; a central pad portion connecting the pair of leg pad portions and structured to receive a seat strap of the safety harness; a pair of handles, wherein each handle is attached to one of the pair of leg pad portions; and elastic cording attached to each of the pair of handles and being structured to bias the pair of handles toward each other and against the pair of leg pad portions.

In accordance with another aspect of the discloses concept, a safety harness comprises: leg straps structured to encircle a user's leg when the safety harness is worn by the user; a seat strap structured to traverse a buttocks area of the user when the safety harness is worn by the user; shoulder straps structured to extend over the user's shoulders when the safety harness is worn by the user; an attachment point attached to the shoulder straps and being structured such that a lifeline may be coupled to the safety harness via the attachment point; and a leg pad assembly including: a pair of leg pad portions structured to receive leg straps of the safety harness; a central pad portion connecting the pair of leg pad portions and structured to receive a seat strap of the safety harness; a pair of handles, wherein each handle is attached to one of the pair of leg pad portions; and elastic cording attached to each of the pair of handles and being structured to bias the pair of handles toward each other and against the pair of leg pad portions.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
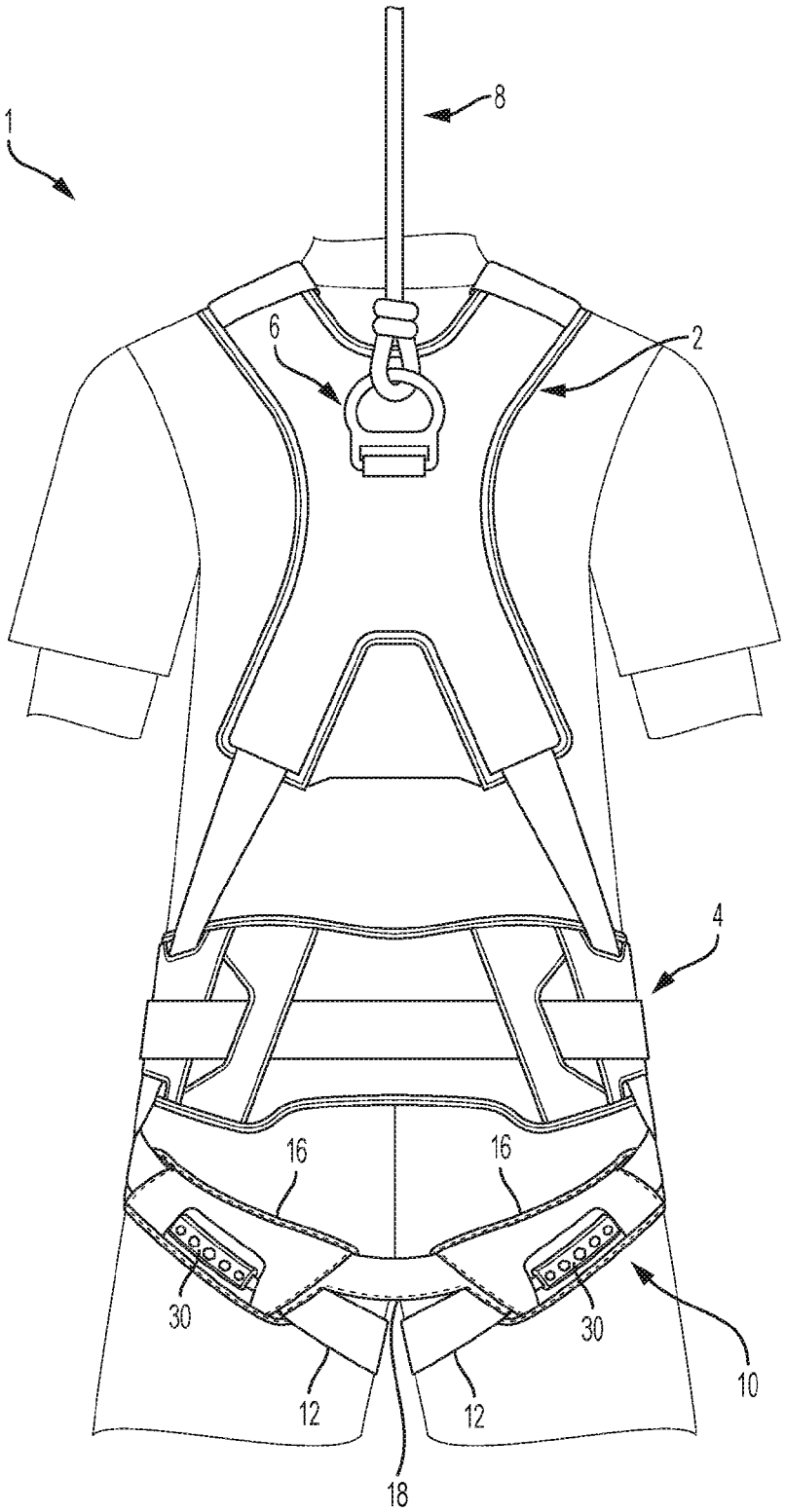
FIG. 1 is rear view of a safety harness including a leg pad assembly in accordance with an example embodiment of the disclosed concept.

Directional phrases used herein, such as, for example, left, right, front, back, top, bottom and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

FIG. 1 is an illustration of a safety harness 1 in accordance with an example embodiment of the disclosed concept. The safety harness 1 is designed to be worn by a person and used in conjunction with a fall protection system. The safety harness 1 includes a shoulder strap assembly 2, a belt assembly 4, a leg pad assembly 10, leg straps 12, and a seat strap 14. An attachment point 6 is attached to the shoulder strap assembly 2 such that the safety harness 1 may be attached to a lifeline 8 of a fall protection system via the attachment point 6. In some example embodiments of the disclosed concept, the attachment point 6 may be a d-ring. However, it will be appreciated by those having ordinary skill in the art that other mechanisms for attaching the safety harness 1 to the lifeline 8 may be employed as the attachment point 6 without departing from the scope of the disclosed concept.

The shoulder strap assembly 2 is formed from various straps and pads and is structured to extend over the user's shoulders. While one example of a shoulder strap assembly 2 in accordance with the disclosed concept is shown, it will be appreciated that variations of shoulder strap assemblies may be employed without departing from the scope of the disclosed concept.

The belt assembly 4 is also formed from various straps and pads and is structured to extend around the user's waist. While one example of a belt assembly 4 in accordance with the disclosed concept is shown, it will be appreciated that variations of belt assemblies may be employed without departing from the scope of the disclosed concept. Additionally, it will be appreciated that in some embodiments of the disclosed concept, the belt assembly 4 may be omitted. Generally, the shoulder strap assembly 2 and the leg straps 12 are sufficient to support the user. However, the belt assembly 4 adds additional support.

The leg straps 12 are straps that encircle the user's legs. The leg straps 12 attach to the belt assembly 4. In some embodiments the leg straps 12 may attach to the should strap assembly 2 in addition to or instead of the belt assembly 4. The seat strap 14 extends between the leg straps 12 and is positioned so that it extends across the user's buttocks area when the safety harness is worn.

The leg pad assembly 10 is attached to the safety harness 1 over portions of the leg straps 12 and seat strap 14. The leg strap assembly 10 includes leg pad portions 16 and a central pad portion 18. The leg strap assembly 10 also includes handles 30. The handles 30 are exposed via openings in the leg pad portions 16 so that the user wearing the safety harness 1 can grab the handles 30 with their hands.

Figure 2:
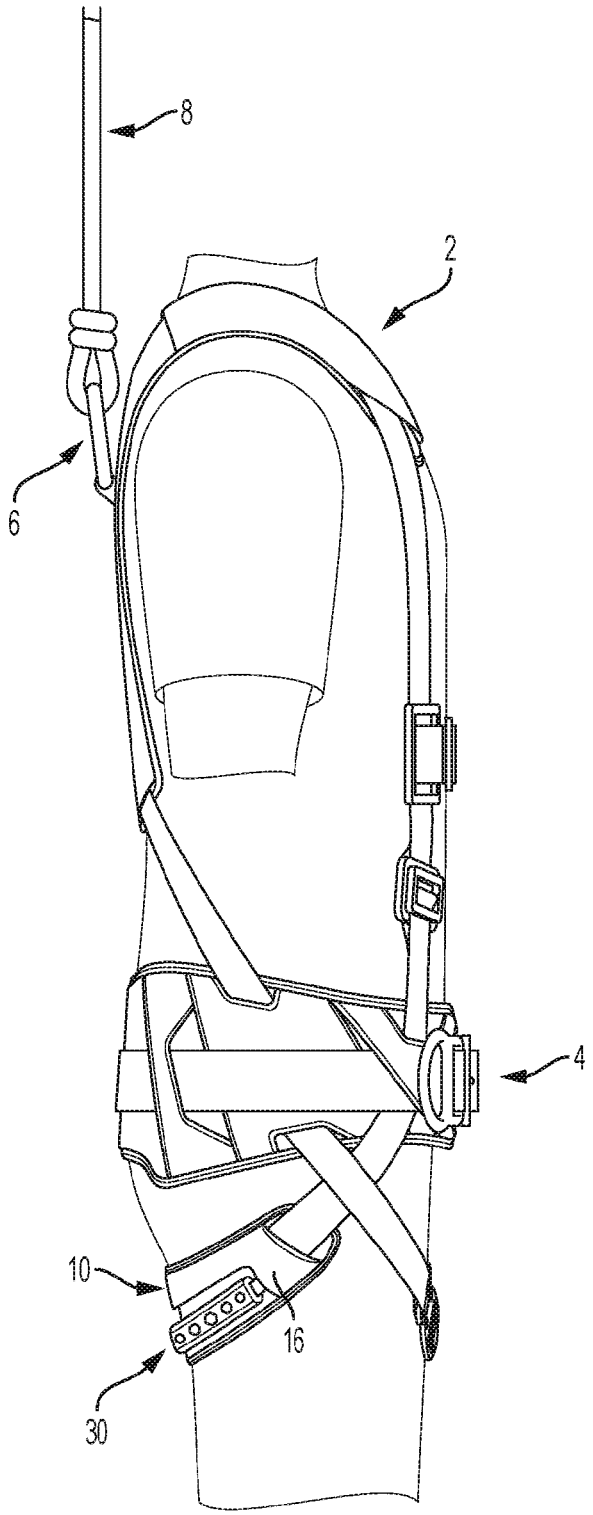
FIG. 2 is a side view of the safety harness of FIG. 1.
Figure 3:
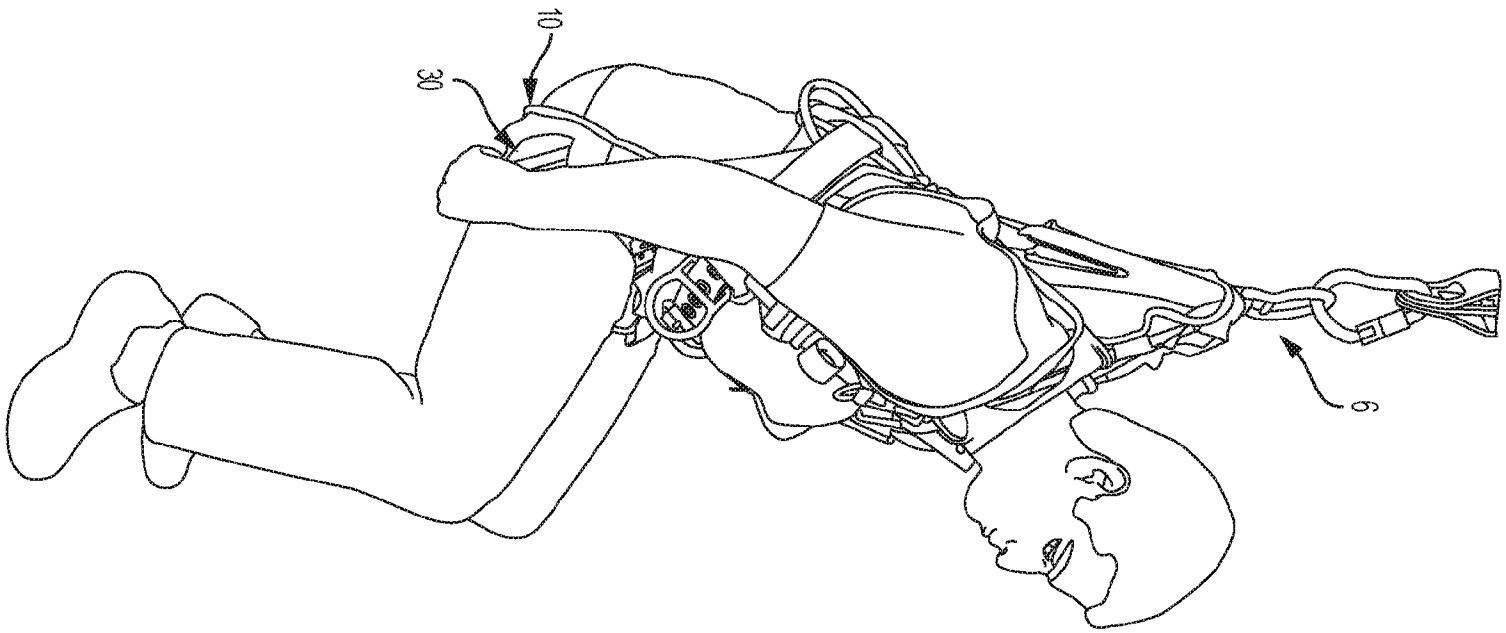
FIG. 3 is a side view of a user adjusting a position of the safety harness of FIG. 1.
Figure 4:
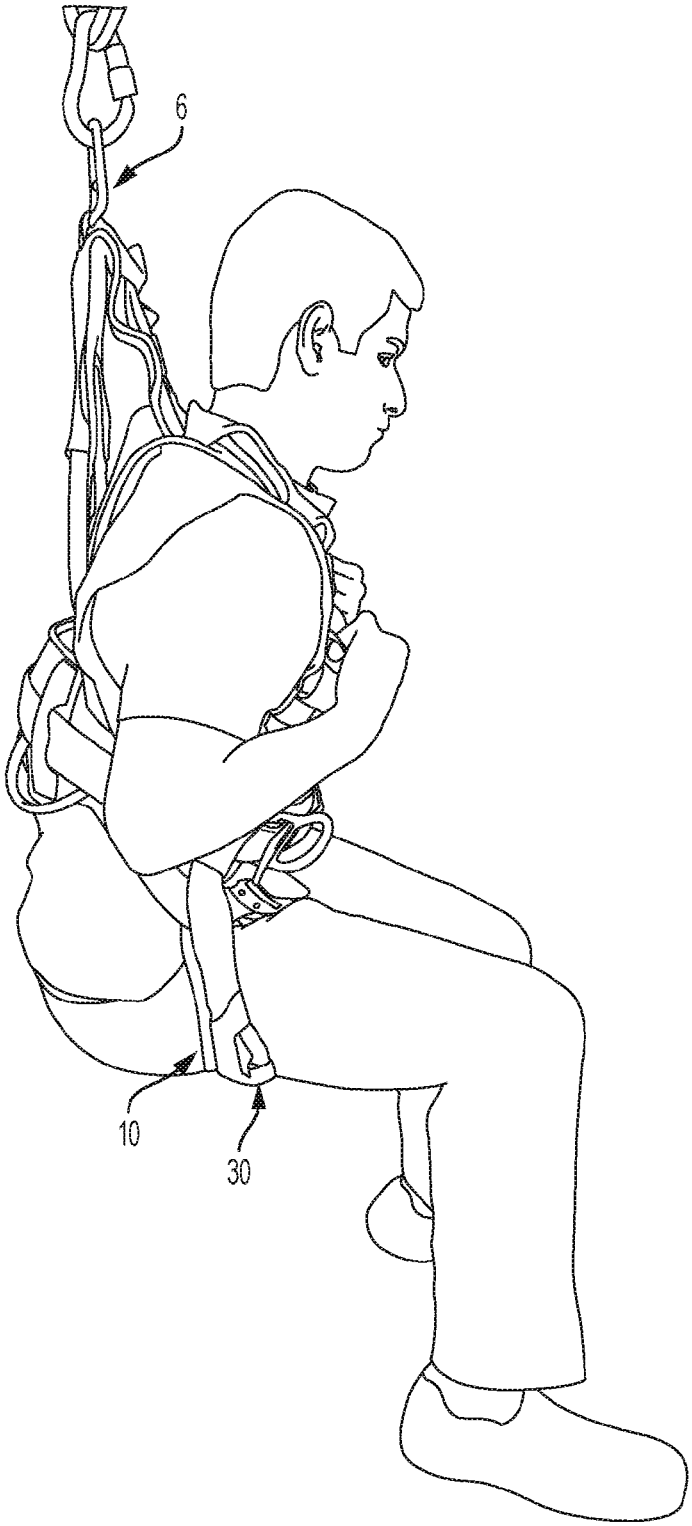
FIG. 4 is a side view of a user after adjusting the position of the safety harness of FIG. 1.

When a user wearing the safety harness 1 falls and ends up suspended by the safety harness 1, the user will be in a substantially vertical position, as is shown, for example in FIGS. 1 and 2. When suspended in the vertical position, the force applied by the leg straps 12 and leg pad assembly 10 to support the worker's weight can be uncomfortable and unhealthy if maintained for an extended period of time. While suspended in the vertical position, the user can grasp the handles 30 and adjust the safety harness 1 in order to be suspended in a seated position rather than the vertical position. An example of the user using the handles 30 to adjust the safety harness 1 to change from the vertical position to the seated position is shown in FIGS. 2-4.

As is shown in FIG. 2, the user is suspended by the safety harness 1 in a substantially vertical position. From the vertical position, the user grasps the handles 30, lifts his legs, and slides the leg straps 12 and leg pad assembly 10 lower on his legs, as is shown in FIG. 3. Using the handles 30 allows the user to gain leverage that is helpful is reducing the force against the leg straps 12 and leg pad assembly 10 so that the adjustment of their position is easier. FIG. 4 shows the suspended in the seated position. In the seated position, the safety harness 1 applies more pressure to the back of the user's leg as opposed to when the user is suspended in the vertical position. The force applied to the back of the user's legs is more natural resulting in a more comfortable and less hazardous position for the user to be suspended in for extended periods of time. Without the handles 30, it would be difficult for the user to gain the leverage need to adjust the safety harness 1 to move from the vertical position to the seated position while suspended.

Figure 5:
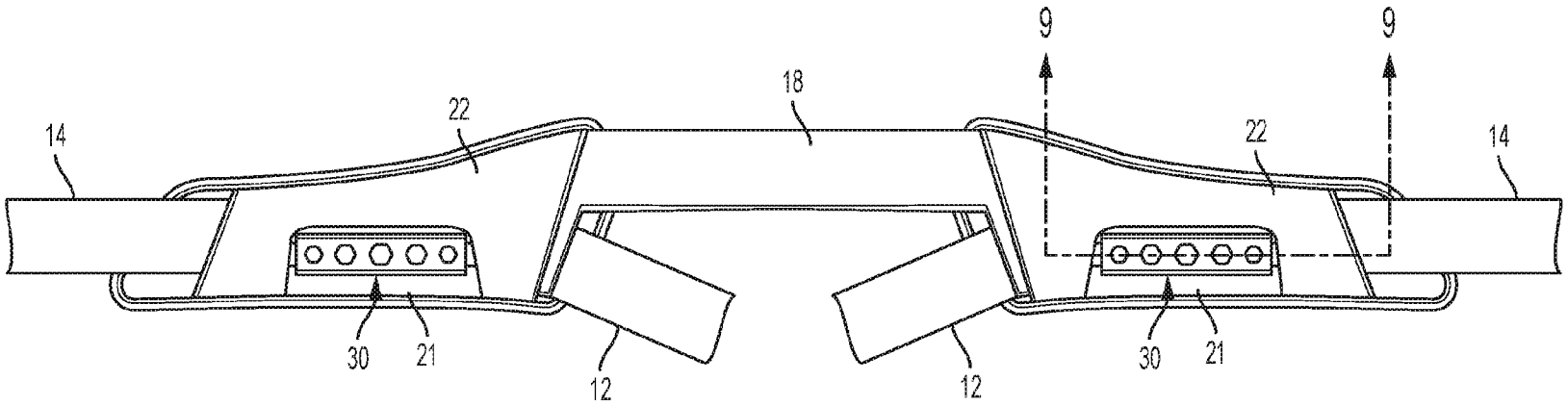
FIG. 5 is a front view of a leg pad assembly in accordance with an example embodiment of the disclosed concept.
Figure 6:
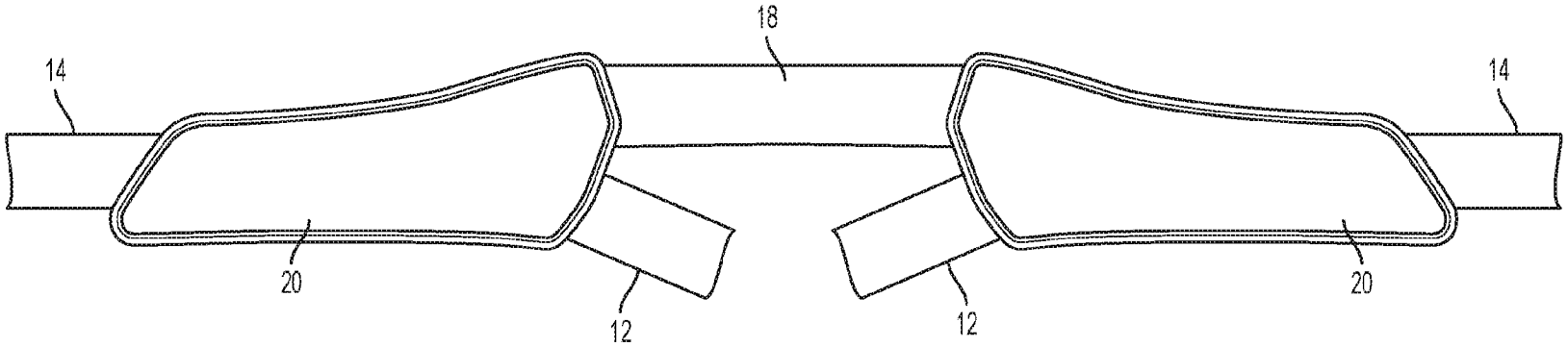
FIG. 6 is a rear view of the leg pad assembly of FIG. 5.
Figure 7:
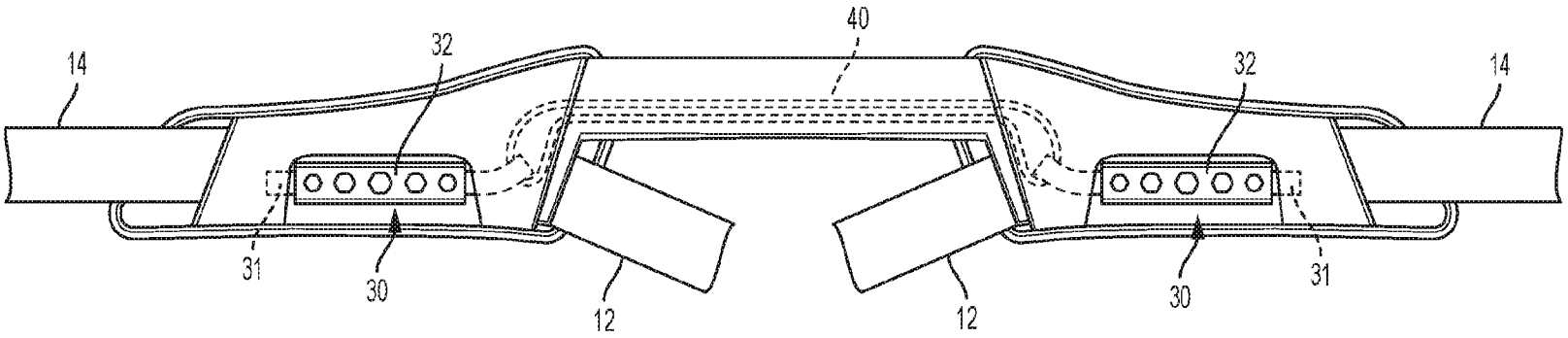
FIG. 7 is a front view of the leg pad assembly of FIG. 5 including additional hidden lines.
Figure 8:
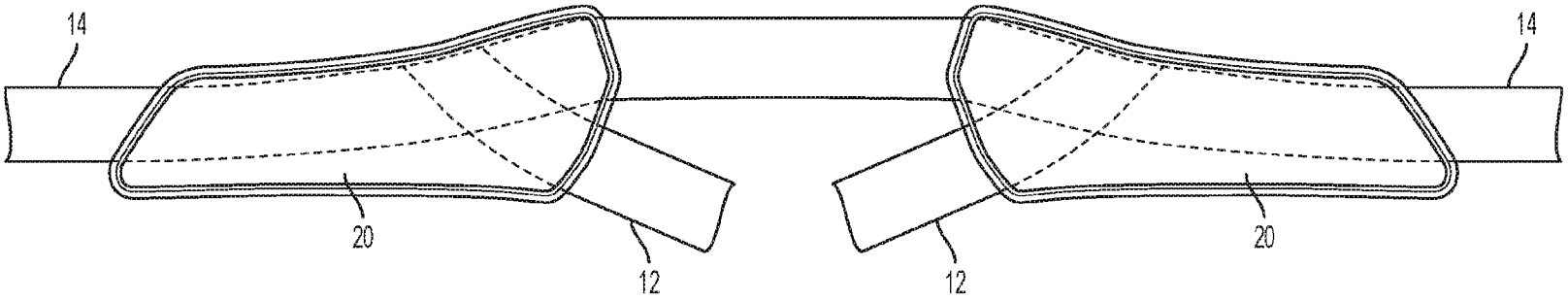
FIG. 8 is a rear view of the leg pad assembly of FIG. 5 including additional hidden lines.
Figure 9:
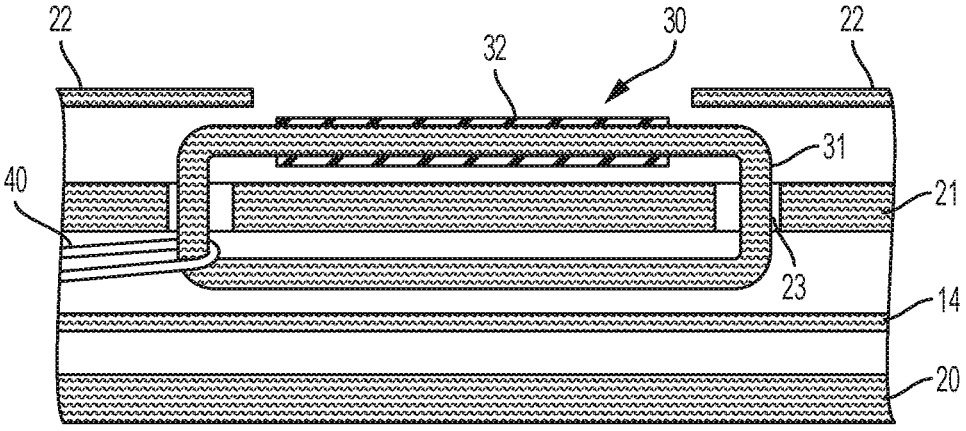
FIG. 9 is a sectional view of the leg pad assembly of FIG. 5.

FIG. 5 illustrates a front view of the leg pad assembly 10 and FIG. 6 illustrates a rear view of the leg pad assembly 10. FIG. 7 illustrates another front view of the leg pad assembly 10, similar to FIG. 5, except that some additional hidden elements are shown in FIG. 7. Similarly, FIG. 8 illustrates another rear view of the leg pad assembly 10 except that some additional hidden elements are shown in FIG. 8. FIG. 9 is a sectional view of the leg pad assembly 10 in the area of one of the handles 30. The construction of the leg pad assembly 10 in accordance with an example embodiment of the disclosed concept will be described with respect to FIGS. 5-9.

The leg pad portions 16 each include an inner leg pad portion 20, an outer leg pad portion 21, and an overlay 22. The inner leg pad portion 20 contacts the user and is disposed between leg strap 12 and the user when the safety harness 1 is worn. The inner and outer leg pad portions 20,21 are disposed on opposite sides of the leg strap 12 so that the leg strap 12 is sandwiched between the inner and outer leg pad portions 20,21. A portion of the seat strap 14 is also sandwiched between the inner and outer leg pad portions 20,21. The leg straps 12 and the seat strap 14 are attached to each other inside the leg pad portions 16, as is shown for example in FIG. 8. The leg straps 12 and the seat strap 14 may be attached in any suitable manner such as, for example and without limitation, stitching them together. The inner and outer leg pad portions 20,21 are attached to each other via any suitable method such as, without limitation, stitching.

The inner and outer leg pad portions 20,21 are also attached to the central pad portion 18. The central pad portion 18 spans between and connects the two leg pad portions 16 and the seat strap 14 passes through the central pad portion 18. The central pad portion 18 may include a padded material such as, without limitation, ballistic nylon.

The overlay 22 is attached to the outer leg pad portion 21 using any suitable method such as, without limitation, stitching. The overlay 22 includes a cutout portion that allows the user to access the handles 30. In some example embodiments of the disclosed concept, the inner and outer leg pad portions 20, 21 include padded material such as, without limitation, ballistic nylon. In some example embodiments of the disclosed concept, the overlay 22 includes a fabric material such as, without limitation Hypalon.

The handles 30 are composed of webbing 31 and a grip portion 32. The webbing 31 forms a loop that passes through the grip portion. The webbing 31 may be composed of a fabric material and the grip portion 32 may be composed of a more resilient material such as a plastic material.

The leg pad assembly 10 further includes elastic cording 40. Referring to FIG. 7, the elastic cording 40 forms a loop attaching each of the handles 30. For example, the elastic cording 40 is threaded through the loop formed by the webbing 31 of one of the handles 30 and is passed through the central strap portion 18 and the loop formed by the webbing 31 of the other one of the handles 30. The elastic cording 40 is then passed back through the central strap portion 18 and attached to itself to form a loop. The elastic cording 40 has an elastic characteristic and is structured so that it pulls the handles 30 toward each other. The force applied by the elastic cording 40 causes the handles 30 to be pulled flush against the outer leg pad portion 21. The user is still able to counteract the force applied by the elastic cording 40 on the handles 30 when needed, but the handles 30 will generally be pulled flush against the outer leg pad portion 21 reducing the chances that they could become snagged on an object.

Referring to FIG. 9, the outer leg pad portions 21 include grommets 23. The grommets 23 are placed in the outer leg pad portions 21 such that the webbing 31 of the handles 30 can be threaded through the grommets 23. As a result, about half of the loop formed by the webbing 31 of the handles 30 is located on an interior side of the outer leg pad portion 21 and the other half of the loop formed by the webbing 31 of the handles 30 is located on an exterior side of the outer leg pad portion 21. Threading the webbing 31 through the grommets 23 couples the handles 30 to the outer leg pad portions 21, yet the handles 30 can still be pulled flush to the outer leg pad portion 21 by the elastic cording 40 or pulled slightly away from the outer leg pad portion 21 by the user.

The overlay 22 provides an aesthetically pleasing look to the leg pad assembly 10. In some example embodiments of the disclosed concept, the overlay 22 is shaped so that it covers the grommets 23 in the out leg pad portion 21 yet still has a cutout portion that allows the user to access the handles 30. Covering the grommets 23 provides an aesthetically pleasing look and additionally reduces the risk that the handles 30 may become snagged on an object. The bend in the webbing 31 of the handles 30 where it passes through the grommets 23 is an area where there is a high risk of the handles 30 becoming snagged on an object and covering up the area with the overlay 22 reduces the risk. It will also be appreciated by those having ordinary skill in the art that the overlay 22 may be omitted without departing from the scope of the disclosed concept.

It will be appreciated by those having ordinary skill in the art that the leg pad assembly 10 may be manufactured and attached to the safety harness 1 around the time when the safety harness 1 is manufactured. However, it will also be appreciated by those having ordinary skill in the art that the leg pad assembly 10 may be manufactured independent of the safety harness 1 and attached to the safety harness 1 at a later time. For example, the leg pad assembly 10 may be attached to an existing safety harness as an upgrade for the safety harness.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A leg pad assembly for a safety harness, the leg pad assembly comprising:

a pair of leg pad portions structured to receive leg straps of the safety harness;

a central pad portion connecting the pair of leg pad portions and structured to receive a seat strap of the safety harness;

a pair of handles, wherein each handle is attached to a respective one of the pair of leg pad portions; and elastic cording attached to each of the pair of handles and being structured to bias the pair of handles toward each other and against the pair of leg pad portions.

2. The leg pad assembly of claim 1, wherein the pair of leg pad portions each include:

an outer leg pad portion; and an inner leg pad portion attached to the outer leg pad portion forming an area between the outer leg pad portion and the inner leg pad portion through which a leg strap of the safety harness can pass.

3. The leg pad assembly of claim 2, wherein a first one of the outer leg pad portions includes a first pair of grommets and a second one of the outer leg pad portions includes a second pair of grommets, and wherein a first one of the pair of handles passes through the first pair of grommets and a second one of the pair of handles passes through the second pair of grommets.

4. The leg pad assembly of claim 3, wherein the first one of the pair of handles includes a first grip portion and a first loop of webbing threaded through the first grip portion and the first pair of grommets, and wherein the second one of the pair of handles includes a second grip portion and a second loop of webbing threaded through the second grip portion and the second pair of grommets.

5. The leg pad assembly of claim 4, wherein the first grip portion is formed of a more resilient material than the first loop of webbing and the second grip portion is formed of a more resilient material than the loop of webbing.

6. The leg pad assembly of claim 3, further comprising: a first overlay attached to an exterior surface of the first one of the outer leg pad portions; and a second overlay attached to an exterior surface of the second one of the outer leg pad portions, wherein the first overlay includes a first cutout portion structured to allow a user to access the first one of the pair of handles and the second overlay includes a second cutout portion to allow the user to access the second one of the pair of handles.

7. The leg pad assembly of claim 6, wherein the first overlay covers the first pair of grommets and the second overlay covers the second pair of grommets.

8. The leg pad assembly of claim 1, wherein the pair of leg pad portions and the central pad portion include padded material.

9. A safety harness comprising:

leg straps structured to encircle a user's leg when the safety harness is worn by the user;

a seat strap structured to traverse a buttocks area of the user when the safety harness is worn by the user;

shoulder straps structured to extend over the user's shoulders when the safety harness is worn by the user;

an attachment point attached to the shoulder straps and being structured such that a lifeline may be coupled to the safety harness via the attachment point; and a leg pad assembly including:

a pair of leg pad portions structured to receive leg straps of the safety harness;

a central pad portion connecting the pair of leg pad portions and structured to receive a seat strap of the safety harness;

a pair of handles, wherein each handle is attached to a respective one of the pair of leg pad portions; and elastic cording attached to each of the pair of handles and being structured to bias the pair of handles toward each other and against the pair of leg pad portions.

10. The safety harness of claim 9, further comprising:

a belt assembly structured to extend around the user's waist when the safety harness is worn by the user.

11. The safety harness of claim 9, wherein the attachment point is a d-ring.

12. The safety harness of claim 9, wherein the pair of leg pad portions each include:

an outer leg pad portion; and an inner leg pad portion attached to the outer leg pad portion forming an area between the outer leg pad portion and the inner leg pad portion through which a leg strap of the safety harness can pass.

13. The safety harness of claim 12, wherein a first one of the outer leg pad portions includes a first pair of grommets and a second one of the outer leg pad portions includes a second pair of grommets, and wherein a first one of the pair of handles passes through the first pair of grommets and a second one of the pair of handles passes through the second pair of grommets.

14. The safety harness of claim 13, wherein the first one of the pair of handles includes a first grip portion and a first loop of webbing threaded through the first grip portion and the first pair of grommets, and wherein the second one of the pair of handles includes a second grip portion and a second loop of webbing threaded through the second grip portion and the second pair of grommets.

15. The safety harness of claim 14, wherein the first grip portion is formed of a more resilient material than the first loop of webbing and the second grip portion is formed of a more resilient material than the second loop of webbing.

16. The safety harness of claim 13, further comprising:

a first overlay attached to an exterior surface of the first one of the outer leg pad portion; and a second overlay attached to an exterior surface of the second one of the outer leg pad portions, wherein the first overlay includes a first cutout portion structured to allow a user to access the first one of the pair of handles and the second overlay includes a second cutout portion to allow the user to access the second one of the pair of handles.

17. The safety harness of claim 16, wherein the first overlay covers the first pair of grommets and the second overlay covers the second pair of grommets.

18. The safety harness of claim 9, wherein the pair of leg pad portions and the central pad portion include padded material.

* * * * *